US006837083B2

(12) United States Patent
Katagiri et al.

(10) Patent No.: US 6,837,083 B2
(45) Date of Patent: Jan. 4, 2005

(54) KEY CYLINDER AND METHOD FOR ASSEMBLING A KEY CYLINDER

(75) Inventors: Toshiharu Katagiri, Aichi (JP); Naokatsu Okamura, Aichi (JP); Yoshinobu Oyabu, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 10/027,721

(22) Filed: Dec. 20, 2001

(65) Prior Publication Data

US 2002/0073754 A1 Jun. 20, 2002

(30) Foreign Application Priority Data

Dec. 20, 2000 (JP) ..... 2000-387440
Dec. 20, 2000 (JP) ..... 2000-387441
Dec. 20, 2000 (JP) ..... 2000-387442

(51) Int. Cl.[7] ..... E05B 17/04

(52) U.S. Cl. ..... 70/379 R; 70/367; 70/370; 70/380; 70/DIG. 36

(58) Field of Search ..... 70/379 R, 367–371, 70/380, 466, DIG. 36, DIG. 54; 292/DIG. 61, DIG. 52

(56) References Cited

U.S. PATENT DOCUMENTS 1,998,288 A * 4/1935 Roberts ..... 70/150
2,021,241 A * 11/1935 Mall ..... 285/276
2,655,028 A * 10/1953 Jacobi ..... 70/367
3,143,874 A * 8/1964 Jacobi ..... 70/379 R
3,434,316 A * 3/1969 Neary ..... 70/371
4,014,195 A * 3/1977 Grogan ..... 70/379 R
4,228,669 A * 10/1980 Bischoff ..... 70/379 R
4,550,580 A 11/1985 Neyret ..... 70/370
4,866,964 A * 9/1989 Hall ..... 70/369
5,428,978 A * 7/1995 Tsukano ..... 70/386
5,640,864 A * 6/1997 Miyamoto ..... 70/379 R
5,737,950 A 4/1998 Yun-Bin ..... 70/379
6,105,405 A 8/2000 Westwinkel ..... 70/371
6,109,080 A * 8/2000 Chen et al. ..... 70/371
6,523,378 B2 * 2/2003 Kuo ..... 70/360
6,564,601 B2 * 5/2003 Hyatt Jr. ..... 70/278.3
6,568,229 B1 * 5/2003 Heinrich ..... 70/370

FOREIGN PATENT DOCUMENTS

DE 19720476 A1 11/1998

* cited by examiner

*Primary Examiner*—John B. Walsh
(74) *Attorney, Agent, or Firm*—Sheridan Ross PC

(57) ABSTRACT

A key cylinder selectively locks and unlocks a lock mechanism. The key cylinder has a rotor and a lever. The rotor is rotated by a key. The lever connects the rotor to the lock mechanism. The key cylinder has a recess formed in an end of the rotor. An end portion of the lever fits in the recess. A cushion is located between the basal end of the lever and the recess. The cushion holds the lever such that an axis of the lever and an axis of the rotor forms an angle within a predetermined range of angles.

9 Claims, 11 Drawing Sheets

KEY CYLINDER AND METHOD FOR ASSEMBLING A KEY CYLINDER

BACKGROUND OF THE INVENTION

The present invention relates to a key cylinder for selectively locking or unlocking a lock mechanism to lock or unlock a vehicle door panel and to a method for assembling the key cylinder.

A prior art key cylinder, which is fitted in a vehicle door panel, includes a rotor. The rotor is rotated by a key. A rod lever is connected to one end of the rotor. The rod lever is rotated and swung integrally with the rotor. Therefore, the rotation of the rotor, which is caused by the key, is transmitted to the rod lever. The movement of the rod lever selectively locks and unlocks a lock mechanism in accordance with the movement of rod lever.

When the key cylinder is assembled, a plurality of lock plates is attached to the rotor. A dummy key is then inserted in the rotor to prevent the lock plates from falling out of the rotor. Unlike a standard key that depresses the lock plates to allow the rotation of the rotor, the dummy key is a grooveless key that prohibits the rotation of the rotor.

A back spring is arranged in a rotor case. After the dummy key is replaced with an authentic key, the rotor is fitted in the rotor case. That is, the rotor is pushed into the rotor case while rotating the rotor with the authentic key. When the ends of the back spring engage associated engagement portions defined in the rotor, the fitting of the rotor into the rotor case is completed.

There is only one authentic key for each cylinder. Therefore, when the rotor and the rotor case are assembled together, the dummy key must be replaced by the authentic key in each cylinder. This requires the authentic key and the key cylinder to be handled together on an assembly line. Also, the need for the replacement of the dummy key with the authentic key increases the number of the steps of the assembling process.

In the rod lever type key cylinder, the basal end of the rod lever must be connected to the basal end of the rotor with a setscrew, a pin, or some other device that prevents separation of the rod lever from the key cylinder. It is thus difficult to assemble the key cylinder. Additionally, when the key cylinder is fitted in an installation portion (installation hole) of a door panel, the rod lever must be manually supported so that the axis of the rod lever coincides with the axis of the rotor. If the rod lever is not manually supported, the weight of the rod lever causes the rod lever to incline, in accordance with the gravity. Therefore, the key cylinder cannot be fitted in the installation portion of the door panel without manually supporting the rod lever during installation. This decreases the assembling efficiency of the key cylinder.

There is a plate lever type key cylinder, in addition to the rod lever type key cylinder. The plate lever type includes a plate lever, which is fixed to an end of a rotor and is integrally rotated with the rotor. The plate lever is connected by a rod to a lock mechanism, which is arranged in a door panel. A key rotates the rotor. The rotation of the rotor is transmitted to the rod by the plate lever. This shifts the lock mechanism between a locked state and an unlocked state.

The key cylinders include main bodies having substantially the same structure. However, the levers of the plate type cylinder and the rod type cylinder each employ an exclusive rotor and rotor case. Thus, the rotor and rotor case of the plate type cylinder is manufactured separately from those of the rod type cylinder.

SUMMARY OF THE INVENTION

Accordingly, it is a first object of the present invention to provide a key cylinder that improves assemblage efficiency. Another object of the present invention is to provide a lever unit, which copes with any lever, regardless of a different installation structure, and a key cylinder including the lever unit.

To attain the above object, the present invention provides a key cylinder for selectively locking and unlocking a lock mechanism. The key cylinder has a rotor capable of being rotated by a key, and a lever for connecting the rotor to the lock mechanism The key cylinder has a recess and a holder. The recess is formed in an end of the rotor. An end portion of the lever fits in the recess. A holder is located between the end portion of the lever and the recess. The holder holds the lever such that an axis of the lever and an axis of the rotor forms an angle within a predetermined range of angles.

The present invention also provides another key cylinder. The key cylinder has a rotor case and a rotor. The rotor is located in the rotor case. An engagement portion is formed in the rotor. The rotor is rotated in accordance with an operation of a key. A back spring is located about the rotor case. An end portion of the back spring engages within the engagement portion. A guide portion is formed in an end portion of the rotor. When the rotor is attached to the rotor case, the guide portion guides the end portion of the back spring to the engagement portion.

The present invention also provides an assembly method of a key cylinder. The method includes mounting a back spring to a rotor case and inserting a rotor, which rotates in accordance with an operation of a key, into the rotor case. At least one of an end portion of the back spring is guided to an engagement portion, which is formed in the rotor, along a guide portion of the rotor.

The present invention also provides a lever unit forming a part of a key cylinder and having a first lever. The lever unit is located between a rotor of the key cylinder and a lock mechanism. The rotor has a mounting portion, which can mount another lever having a different structure from that of the first lever. The lever unit has an intermediary member mounted on the mounting portion. The first lever is connected to the intermediary member.

The present invention also provides a key cylinder for selectively locking and unlocking a lock mechanism. The key cylinder has a rotor and a lever unit. The rotor is rotated in accordance with an operation of a key. The lever unit has a first lever. The lever unit is located between the rotor and the lock mechanism. The rotor has a mounting portion, which can mount another lever having a different structure with that of the first lever. The lever unit includes an intermediary member mounted on the mounting portion. The first lever is connected to the intermediary member.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 9(*b*) is a cross-sectional view taken along line 9*b*—9*b* of FIG. 8;

FIG. 10(*b*) is a front view showing the rotor case of FIG. 4 when the rotor starts being assembled with the rotor case;

FIG. 10(*c*) is a front view showing the rotor case of FIG. 4 when the rotor is being assembled with the rotor case;

FIG. 10(*d*) is another front view showing the rotor case of FIG. 4 when the rotor is being assembled in the rotor case;

FIG. 12(*b*) is a front view of the key cylinder of FIG. 11, in which the plate lever is attached to a projection of a rotor;

FIG. 12(*c*) is a partial rear view of the key cylinder of FIG. 11, in which the plate lever is attached to the rotor case;

FIG. 13(*b*) is a front view of the lever unit of FIG. 11;

FIG. 13(*c*) is a rear view of the lever unit of FIG. 11;

FIG. 13(*d*) is a cross-sectional view of the lever unit of FIG. 11;

FIG. 14(*b*) is a cross-sectional view taken along a line 14*b*—14*b* of FIG. 14(*a*); and FIG. 14(*c*) is a rear view of the main portion of the key cylinder of FIG. 11, in which the lever unit is attached to the main portion.

DETAILED DESCRIPTION OF THE PREFERRED EMBODIMENTS

A key cylinder 10 according to a first embodiment of the present invention will now be described with reference to FIGS. 1 to 3. The key cylinder 10 is fitted in a vehicle door panel (not shown).

Figure 1:
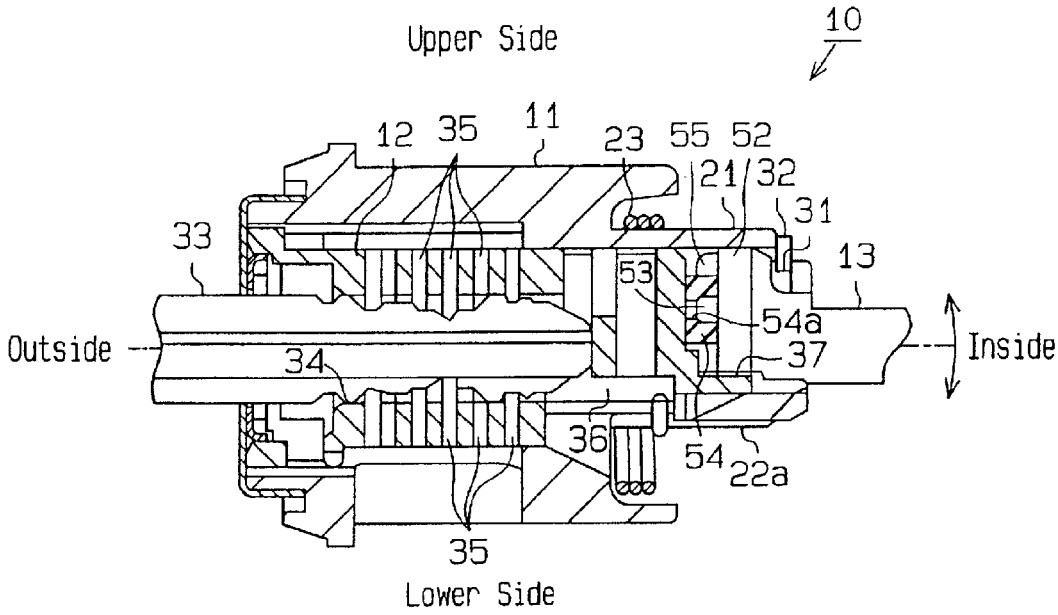
FIG. 1 is a cross-sectional view showing a key cylinder according to a first embodiment of the present invention.

Referring to FIG. 1, the key cylinder 10 includes a rotor case 11, which is fixed to the vehicle door panel. A cylindrical rotor 12, which rotates around an axis L, is housed in the rotor case 11. The basal end of a rod-like lever 13 (described later) is connected to one end of the rotor 12 to rotate integrally with the rotor 12. The lever 13 has a distal end. The distal end is connected to a lock mechanism (not shown), which is arranged in the door panel. The left side of FIG. 1 corresponds to the direction of the outer side of the door panel. The right side of FIG. 1 corresponds to the direction of the inner side of the panel.

Figure 3:
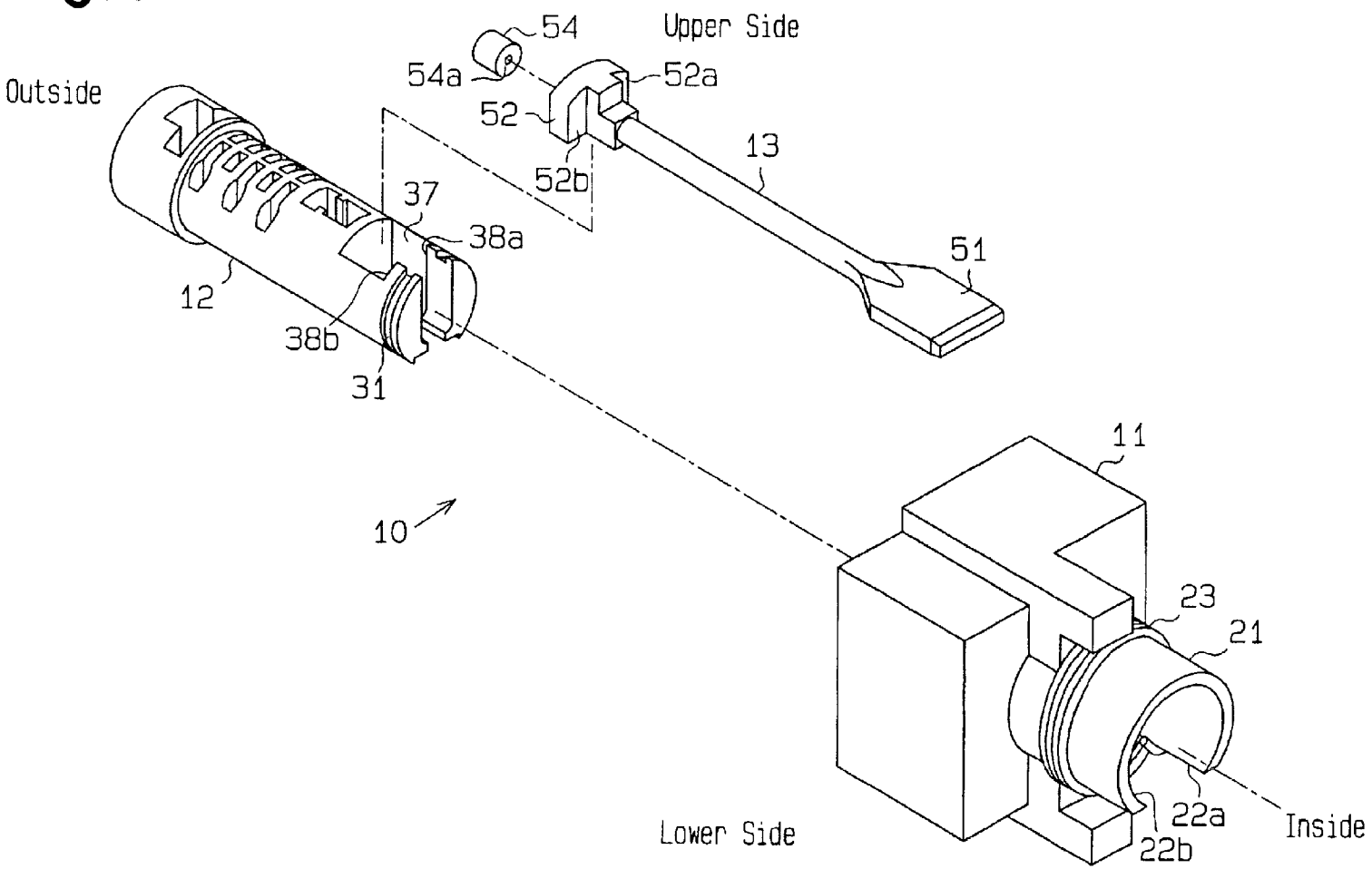
FIG. 3 is an exploded perspective view showing the rotor, the rod lever, and a rotor case of FIG. 1.

As shown in FIG. 3, the rotor case 11 includes a protector 21. A cut-away portion is defined in part of the peripheral wall of the protector 21. Hooking portions 22*a*, 22*b* are formed on the edges of the peripheral wall, which define the cut-away portion. A back spring 23 is wound about the outer surface of the protector 21. Both ends of the back spring 23 are bent toward the axis of the spring 23 and locked in the associated hooking portions 22*a*, 22*b*, respectively. Only one of the ends of the back spring 23 is shown in FIGS. 1 and 3.

As shown in FIG. 1, the inner end of the rotor 12 projects from the protector 21 of the rotor case 11. An annular groove 31 is defined in the part of the rotor 12, which projects from the protector 21. The groove 31 is situated near an end face of the protector 21. A stopper ring 32, such as an E ring, is fitted in the groove 31. The stopper ring 32 is locked by the end face of the protector 21. This restricts the movement in the axial direction of the rotor 12 (the movement of left direction of FIG. 1).

Referring to FIG. 1, a keyhole 34 is defined in the rotor 12. A key 33 is inserted in the keyhole 34. Lock plates 35 are arranged in the keyhole 34 such that the lock plates 35 face one another and are equidistantly spaced from each other in the axial direction L. Each lock plate 35 is urged toward the center of the radial direction of the keyhole 34 by elastic force of a spring (not shown). Each lock plate 35 is moved radially (in a vertical direction in FIG. 1) with respect to the axis of the rotor 12. When the key 33 is inserted into the keyhole 34, the lock plates 35 are moved vertically with respect to the serrations of the key 33 such that the rotor 12 can rotate. When the key 33 is pulled out of the keyhole 34, the rotation of the rotor 12 is prohibited.

An engagement recess 36 is defined in the lower portion of the rotor 12. Both opposite side walls of the engagement recess 36 lock both ends of the back spring 23 (the end portion of the back spring 23) in corporation with the hooking portions 22*a*, 22*b* (only hooking portion 22*a* is shown in FIG. 1). When the rotor 12 is rotated by the key 33, the back spring 23 is pressed in the radial direction. As a result, the rotor 12 is urged in a direction opposite to the direction of the rotation by elastic force of the back spring 23.

Figure 2:
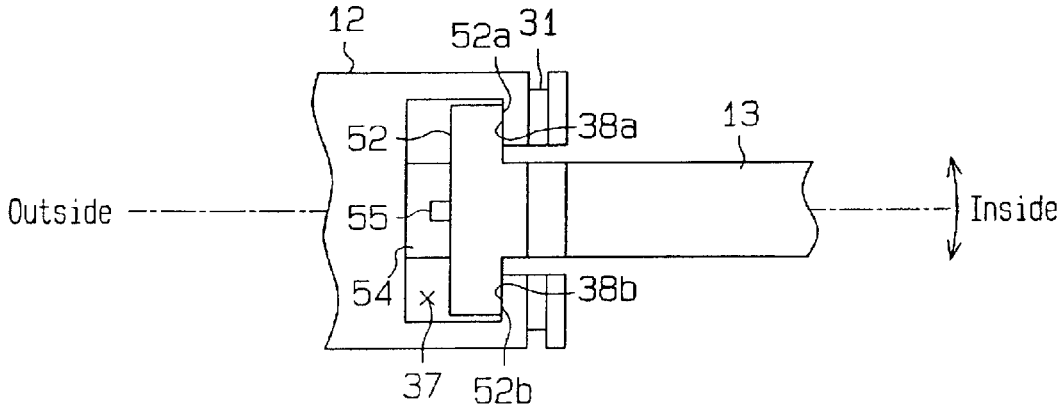
FIG. 2 is a plan view showing a main portion connecting a rotor and a rod lever of FIG. 1.

Referring to FIGS. 1 and 2, an accommodating portion 37, or a recess, is defined in the upper portion of the rotor 12. The accommodating portion 37 includes a pair of engagement steps 38*a*, 38*b*. The engagement steps 38*a*, 38*b* are perpendicular to the axis of the rotor 12. The engagement steps 38*a*, 38*b* are spaced from each other by a predetermined distance. The lever 13 is arranged between the steps 38*a*, 38*b*.

Referring to FIG. 3, a flat portion 51 is formed at a distal end of the lever 13. A flange 52 is formed at the basal end of the lever 13. As shown in FIG. 2, the flange 52 includes engagement faces 52*a*, 52*b*, which are perpendicular to the axial direction of the lever 13. The engagement faces 52*a*, 52*b* engage the corresponding engagement steps 38*a*, 38*b* of the rotor 12. With reference to FIG. 1, a pin 53 projects from the center of the basal end of the flange 52. The pin 53 is inserted in a cylindrical cushion 54. The cushion 54, which is made of a rubber material, serves as a holder and an elastic member.

As shown in FIG. 3, a receiving hole 54*a* is defined in the middle of the cushion 54. The diameter of the receiving hole

54*a* is slightly smaller than the outer diameter of the pin 53. Elastic force acts on the peripheral surface of the pin 53 toward the inner side of the radial direction of the cushion 54. The elastic force prevents the cushion 54 from separating from the pin 53. The length of the cushion 54 in the axial direction is slightly greater than the length in the axial direction of the pin 53.

Referring to FIGS. 1 and 2, the flange 52 of the lever 13 is arranged in the accommodating portion 37 with the pin 53 inserted in the cushion 54. That is, the cushion 54 is interposed between the flange 52 and the accommodating portion 37. When the flange 52 is not located in the accommodating portion, the distance between each engagement face 52*a*, 52*b* and the distal end of the cushion 54 is slightly greater than the distance between each engagement step 38*a*, 38*b* and an inner face of the accommodating portion 37 that face the engagement steps 38*a*, 38*b*.

When the cushion 54 is fitted in the accommodating portion 37, the cushion 54 is compressed in the axial direction L. Consequently, the flange 52 is urged toward the engagement steps 38*a*, 38*b* by the elastic force of the cushion 54. The close contact of the engagement faces 52*a*, 52*b* of the flange 52 with the associated engagement steps 38*a*, 38*b* retains the lever 13 in the middle position where the axis of the lever 13 and the axis of the rotor 12 coincide with each other. In other words, the holder (cushion 54) holds the lever 13 such that an axis of the lever 13 and an axis of the rotor 12 form an angle within a predetermined range of angles. In this embodiment, the engagement steps 38*a*, 38*b* serve as a receiving portion, which receives the flange 52. 0

As shown in FIG. 1, a projection 55 juts out from the upper portion of the end face of the flange 52. The projection 55 contacts a peripheral surface of the cushion 54. The projection 55 restricts upper deformation of the cushion 54 when the flange 52 with the cushion 54 attached to it is fitted into the accommodating portion 37. Thus, the flange 52 and the cushion 54 are smoothly accommodated in the accommodating portion 37.

The distance between the engagement steps 38*a* and 38*b* is slightly greater than the outer diameter of the main body of the lever 13. A very narrow space is defined between a side surface of the flange 52 and the inner surface of the accommodating portion 37 facing the side surface of the flange 52. The space enables the lever 13 to be swung vertically and horizontally (in a direction indicated by an arrow in each FIGS. 1, 2) around the basal end of flange 52, which functions as a fulcrum. As the lever 13 is swung, the cushion 54 is elastically deformed. The rotation of the lever 13 is restricted when both ends of the flange 52 abut on the associated inner faces of the accommodating portion 37. Accordingly, the rotation of the rotor 12 is transmitted to the lever 13. The lever 13 is integrally rotated with the rotor 12.

The assembly of the key cylinder will now be described with reference to FIG. 3. At first, a dummy key (not shown) is inserted in the rotor 12 to prevent each lock plate 35 (see FIG. 1) from falling. In this state, the flange 52, with the cushion 54 attached to it, is fitted into the accommodating portion 37 of the rotor 12. The rotor 12 is inserted in the rotor case 11 from an outer end of the rotor 12, about which the back spring 23 is wound in advance. Then, the stopper ring 32 is fitted in the groove 31 defined in the distal end of the rotor 12. At this time, as shown in FIG. 1, the fitted portions of the rotor 12 and lever 13 are covered with the protector 21, which is the part of the peripheral wall of the rotor case 11. Thus, the assembly of the key cylinder 10 is completed.

When the key cylinder 10 is fitted in the door panel (not shown), the key cylinder 10 is attached to an installation portion of the door panel while the lever 13 is held in the position where the axis of the lever 13 and the axis of the rotor 12 coincide. Thereafter, the flat portion 51 of the lever 13 is connected to a connecting portion of the lock mechanism. At this time, even if the connecting portion of the lock mechanism is slightly displaced from the axis of the lever 13, the connection is accomplished by swinging the lever 13 to fit with the connecting portion of the lock mechanism.

The fitting of the key cylinder 10 in the door panel is thus completed. When the rotor 12 is rotated by the key 33 in this state, the rotation of the rotor 12 is transmitted to the lock mechanism (not shown) by the lever 13. Thus, the lock mechanism is selectively switched between a locked state and an unlocked state in accordance with the rotation of the rotor 12. In the present embodiment, the key cylinder 10 is attached to the door panel such that the protector 21 faces upward, that is, in the direction of a window.

The present invention has the following advantages and effects.

The flange 52 of the lever 13 is fitted in the accommodating portion 37 of the rotor 12. Therefore, the rotor 12 and the lever 13 are fitted together simply by fitting the flange 52 of the lever 13 into the accommodating portion 37 of the rotor 12. This eliminates the need to fix the lever 13 to the rotor 12 with a setscrew and a pin. This improves the efficiency in fitting the lever 13 to the rotor 12. Additionally, since the setscrew and the pin, which are members for fixing the lever 13, are unnecessary, the number of components is decreased.

In the state where the rotor 12 is fitted in the rotor case 11, the fitted portions of the rotor 12 and lever 13 are covered with the protector 21 of the rotor case 11. Therefore, the fitted portions are shielded from dust and water. This prevents degradation in the operation of the lever 13. Additionally, the fitted portions are prevented from being directly damaged by fraudulent act (for example, theft). This prevents the fitted portions from being broken. Accordingly, security improves.

The axes of the rotor 12 and lever 13 are perpendicular to the engagement faces 52*a*, 52*b* and the engagement steps 38*a*, 38*b*. Therefore, when the flange 52 and the engagement steps 38*a*, 38*b* of the accommodating portion 37 come into close contact with each other by elastic force of the cushion 54, the lever 13 is retained in the middle position relative to the rotor 12. This structure facilitates the positioning of the lever 13 when the key cylinder 10 is fitted in the door panel. Further, the engagement faces 52*a*, 52*b* respectively come into close contact with the engagement steps 38*a*, 38*b* by the cushion 54. This prevents the lever 13 from being moved unnecessarily and making noises.

The lever 13 is swingable relative to the rotor 12. Therefore, displacement between the lever 13 and the lock mechanism, which is arranged in the door panel, is eliminated by the key cylinder 10. In other words, even if the connecting portion of the lock mechanism is not positioned on the axis of the lever 13 retained in the middle position, the lever 13 is connected to the connecting portion of the lock mechanism by swinging the lever 13.

The protector 21 and the rotor case 11 are integrally formed. That is, one part of the peripheral wall of the rotor case 11 serves as the protector 21. Since the protector 21 is not a separate member, the number of the steps of the manufacturing process and the number of components are decreased.

A key cylinder 100 according to a second embodiment of the present invention will now be described with reference to FIGS. 4 through 10(*d*). Like elements will be denoted with the same reference numbers and will not be described in detail. Only elements differing from the first embodiment of FIGS. 1 to 3 will be described.

Figure 4:
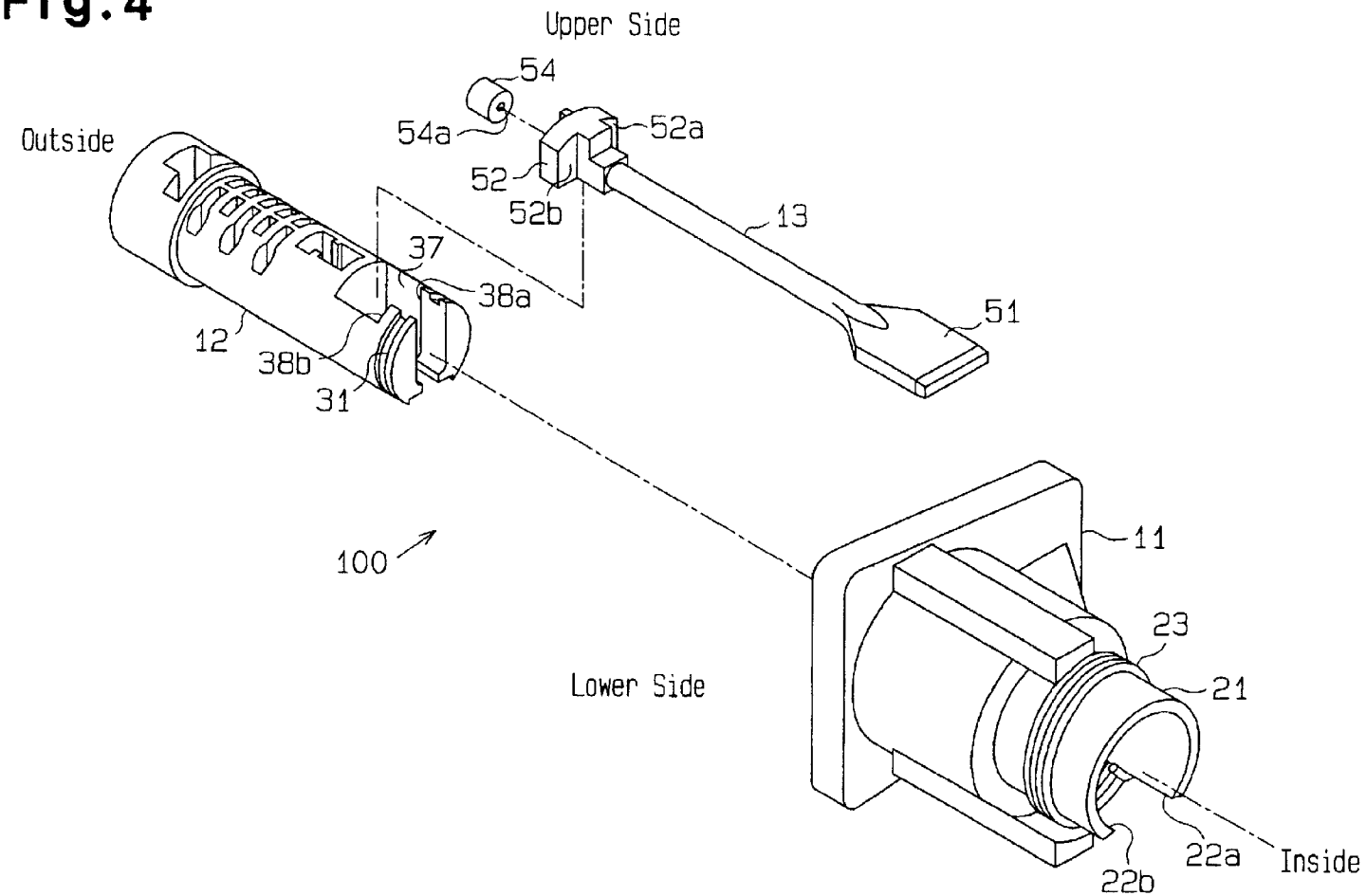
FIG. 4 is an exploded perspective view showing a rotor, a rod lever, and a rotor case according to a second embodiment of the present invention.
Figure 5:
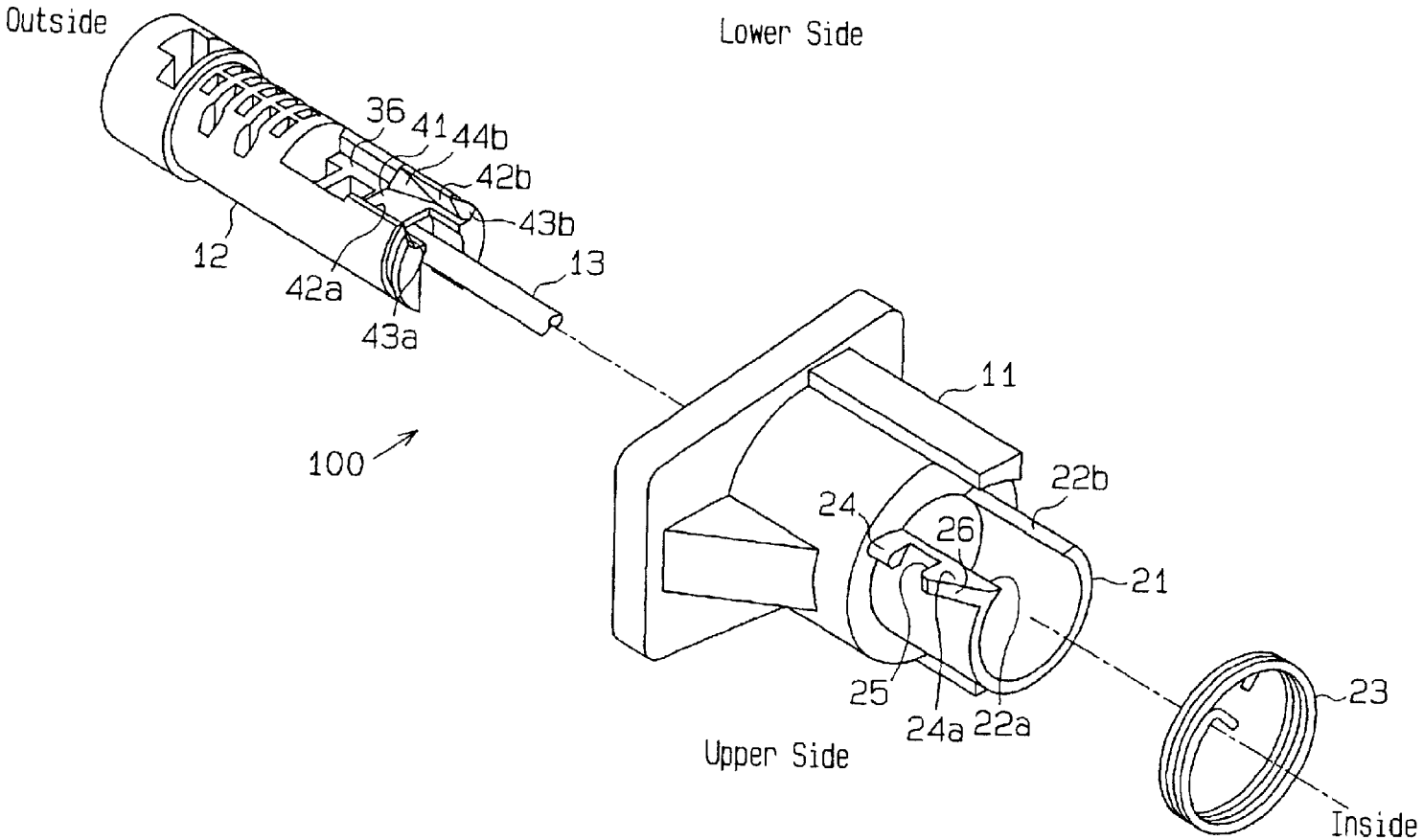
FIG. 5 is an exploded perspective view showing the rotor, the rotor case, and the back spring of FIG. 4.

As shown in FIG. 4, a rotor case 11 of the present invention differs only in shape from the rotor case 11 of FIG. 1, and functions in the same manner as the rotor case 11. Referring to FIG. 5, a projection 24 projects from the peripheral face of the protector 21, along the hooking portion 22*a*. A notch is defined in the projection 24. The width of the notch (a dimension in the axial direction of the rotor case) is determined such that the back spring 23 is accommodated in the notch.

Figure 6:
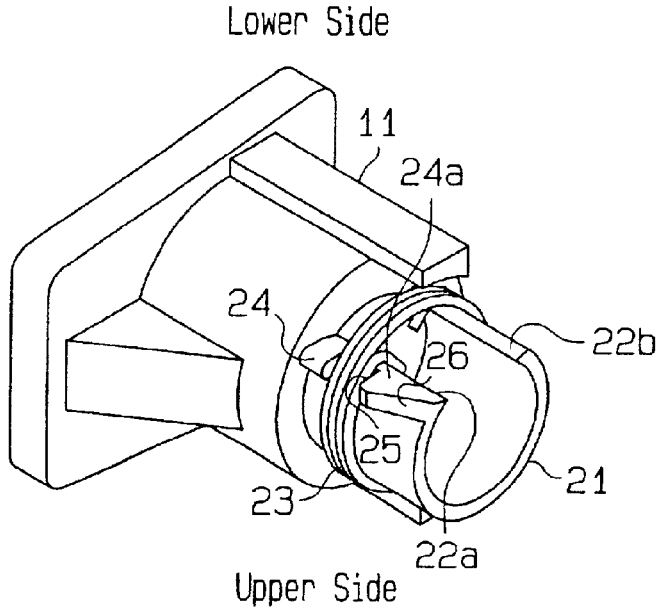
FIG. 6 is a perspective view showing the back spring and the rotor case of FIG. 5, in which the back spring is attached to the rotor case.

As shown in FIG. 6, the projection 24 includes an inclined face 26. The inclined face 26 smoothly connects to a face of the protector 21. The inclined face 26 obliquely extends from the end face of the protector 21 in the direction of the diameter of the end face. A guide portion 24*a* (shown in FIG. 5), which includes the inclined face 26, is defined between the notch 25 and the end face of the protector 21. The guide portion 24*a* guides the back spring 23 into the notch 25. The back spring 23 is wound about a predetermined position (notch 25). The guide portion 24*a* restricts movement of the back spring 23 toward the end face of the protector 21.

Figure 7:
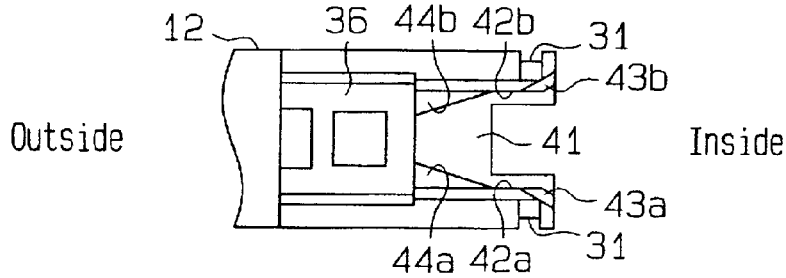
FIG. 7 is a bottom view showing the rotor of FIG. 4.

As described in the first embodiment, an engagement recess 36 is defined in the rotor 12 as shown in FIGS. 5 and 7. Side walls of the engagement recess 36 lock the corresponding ends of the back spring 23 in cooperation with the hooking portions 22*a*, 22*b*, see FIG. 9(*b*).

With reference to FIG. 5 and FIG. 10(*a*), a recess 41 is defined between the engagement recess 36 and the end face of the rotor 12. The recess 41 continues from the engagement recess 36. The recess 41 is shallower than the engagement recess 36. Side walls 42*a*, 42*b*, which define the recess 41, include first guide faces 43*a*, 43*b*, respectively. The distance of between both first guide face 43*a*, 43*b* is greater toward the inner end face of the rotor 12 and toward the outside of the radial direction of the rotor 12.

Figure 8:
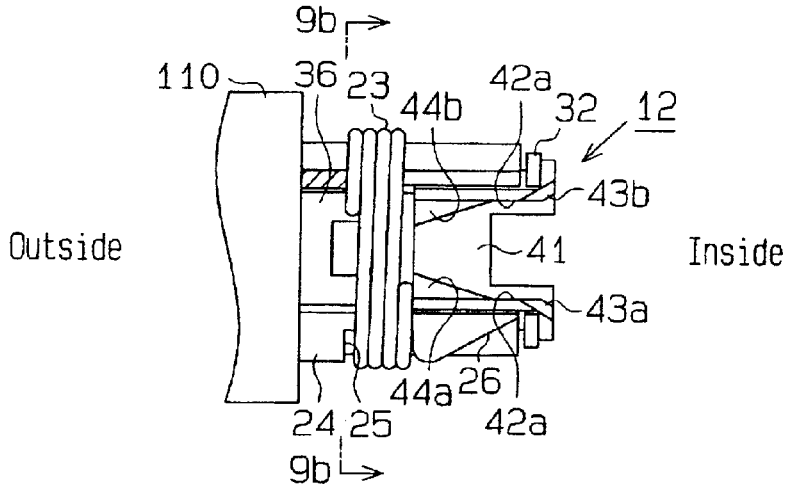
FIG. 8 is a plan view of a main portion of the key cylinder of FIG. 4.
Figure 9A:
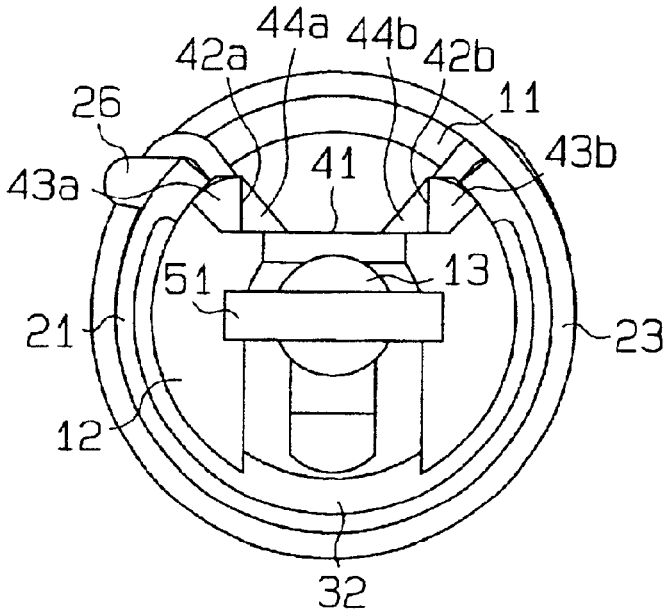
FIG. 9(*a*) is a side view showing the key cylinder of FIG. 4.
Figure 9B:
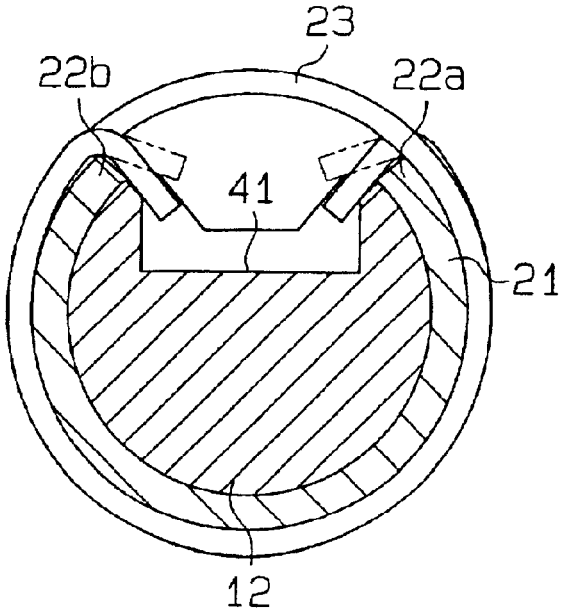
Figure 10A:
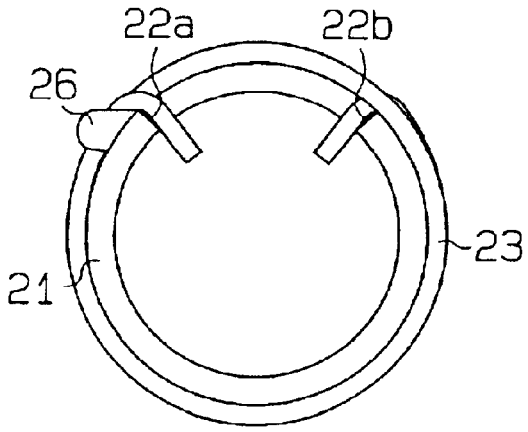
FIG. 10(*a*) is a front view showing the rotor case of FIG. 4 before the rotor is fitted in the rotor case.
Figure 10B:
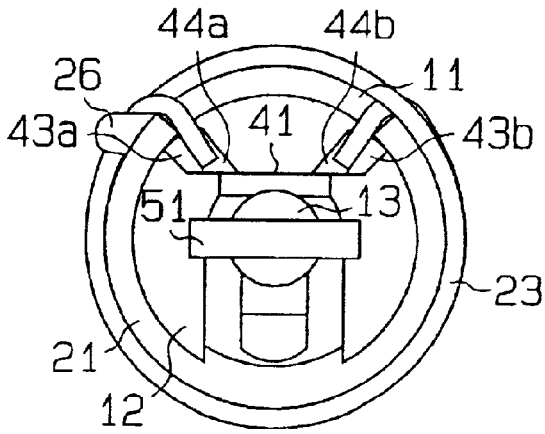
Figure 10C:
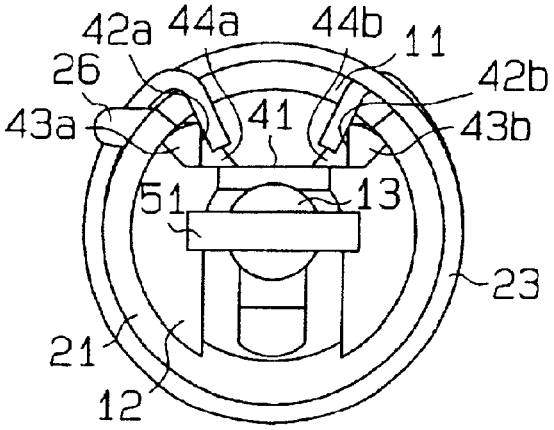
Figure 10D:
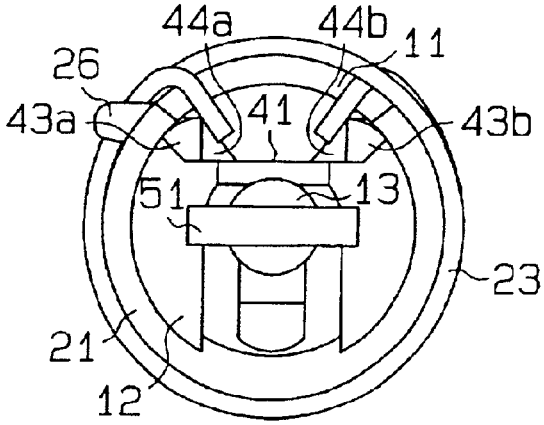

Referring to FIGS. 5, 7, and 8, second guide faces 44*a*, 44*b* are respectively formed in part of the side walls 42*a*, 42*b* of the vicinity of the engagement recess 36. The distance of between both second guide face 44*a*, 44*b* is greater toward the end face of the rotor 12 and toward the outside of the radial direction of the rotor 12. The first guide face 43*a* and the second guide face 44*a* are smoothly connected with each other via an intermediate face of the side wall 42*a*. Likewise, the first guide face 43*b* and the second guide face 44*b* are smoothly connected with each other via an inner face of the side wall 42*b*. The side walls 42*a*, 42*b* constitutes means to guide corresponding ends of the back spring 23 to the engagement recess 36.

The assembly of the key cylinder 100 will now be described with reference to FIG. 4. At first, a dummy key (not shown) is inserted in the rotor 12 to prevent each lock plate 35 (see FIG. 1) from falling. In this state, the flange 52, with the cushion 54 attached to it, is fitted into the accommodating portion 37 of the rotor 12. The rotor 12 is inserted in the rotor case 11 from an outer end of the rotor 12, about which the back spring 23 is wound in advance.

Referring to FIG. 10(*a*), the ends of the back spring 23, before the rotor 12 is fitted in the rotor case 11, are locked by the associated hooking portions 22*a*, 22*b*, and project radially inward. The rotor 12 is inserted in the rotor case 11 such that the ends of the back spring 23 engage the associated first guide faces 43*a*, 43*b*. The back spring 23 engages the notch 25. This restricts movement of the back spring 23 in the axial direction of the rotor case 11.

With reference to FIG. 10(*b*), when the rotor 12 is inserted in the rotor case 11, the ends of the back spring 23 contact the associated first guide faces 43*a*, 43*b* of the rotor 12. When the rotor 12 is pushed into the rotor case 11 in this state, the ends of the back spring 23 are guided by the associated first guide faces 43*a*, 43*b* and, at the same time, are respectively flexed in directions opposite to the directions in which they are bent, (upward in FIG. 10(*b*). As shown in FIG. 10(*c*), when the rotor 12 is pushed into the rotor case 11 from the state shown in FIG. 10(*b*), the ends of the back spring 23 are forced over the corresponding first guide faces 43*a*, 43*b* and guided toward the engagement recess 36 while slid along upper ends of the side walls 42*a*, 42*b*.

With reference to FIG. 10(*d*), when the rotor 12 is further pushed into the rotor case 11 from the state shown in FIG. 10(*c*), the ends of the back spring are guided to the engagement recess 36 via the second guide faces 44*a*, 44*b*. When the ends of the back spring are respectively forced over the second guide faces 44*a*, 44*b*, both ends of the back spring 23 are accommodated in the engagement recess 36, see FIG. 8. The ends of the back spring are slid into the engagement recess 36. At the same time, the ends elastically restores in the direction where the ends are bent, see FIG. 10(*a*). Consequently, the ends are locked by the associated hooking portions 22*a*, 22*b*.

In this state, the rotor 12 is inserted as far as a predetermined position in the rotor case 11, as shown in FIG. 8. The stopper ring 32 is then fitted in the groove 31, which is defined in the distal end of the rotor 12. In this state, the fitted portions of the rotor 12 and lever 13 are covered with the protector 21 of the rotor case 11. Thus, the assembly of the key cylinder 100 is completed.

Thereafter, the same as described in the first embodiment, the key cylinder 100 is attached to the panel.

The present invention has, in addition to the advantages of the illustrated embodiment of FIGS. 1 to 3, the following advantages.

The first guide faces 43*a*, 43*b*, the side walls 42*a*, 42*b*, and the second guide faces 44*a*, 44*b*, all of which guide the corresponding ends of the back spring 23, are formed near the end of the rotor 12. Therefore, the ends of the back spring 23 are guided by the corresponding first guide faces 43*a*, 43*b*, side walls 42*a*, 42*b*, and second guide faces 44*a*, 44*b* merely by pushing the rotor 12 into the rotor case 11, to which the back spring 23 is attached. Consequently, the ends of the back spring 23 engage the engagement recess 36. That is, the rotor 12 is fitted in the rotor case 11 without rotating the rotor 12 by use of the authentic key. Therefore, unlike the prior key cylinder, it is unnecessary to replace the dummy key with the authentic key during the assembly. Accordingly, with the dummy key inserted in the rotor 12, the rotor 12 is fitted in the rotor case 11.

This reduces the number of the steps of the assembling process of the key cylinder 100. Also the assembly is accomplished simply by pushing the rotor 12 into the rotor case 11. This realizes the automation of the process of fitting the rotor 12 into the rotor case 11. Additionally, the assembling process does not require the authentic key. This enables the use of the same dummy key on the assembling line and eliminates the need to handle the authentic key and the key cylinder together.

The basal end of the rod-like lever 13 is connected to the inner end of the rotor 12. This allows the lever 13 to be attached to the rotor 12 before the rotor 12 is fitted in the rotor case 11. On the other hand, in the case of the key cylinder using a platelike lever, the lever projects from the periphery of the rotor 12. This does not allow the lever to be fitted in the rotor 12 before the rotor 12 is fitted in the rotor case 11.

The inclined face 26 for guiding the back spring 23 to the specific installation area of the rotor case 11, specifically the notch 25, is formed in the vicinity of the end of the rotor case 11. Therefore, the back spring 23 can smoothly be attached to the rotor case 11. Also, the back spring 23 is attached to the rotor case 11 simply by being pushed into the rotor case 11. This makes it possible to automate the process of fitting the back spring 23 into the rotor case 11.

If the back spring 23 is assembled to the rotor case 11 after the lever 13 is attached to the rotor 12, a space the length of which is equivalent to that of the lever 13 is needed. In this case, the back spring 23 is fitted to the lever 13 from the distal end of the lever 13, which requires relatively great assembly actions. However, in this embodiment, the back spring 23 is wound about the rotor case 11 in advance. This reduces assembly space and actions that are required to assemble the key cylinder.

A key cylinder 200 according to a third embodiment of the present invention will now be described with FIGS. 11 to 14(*c*).

Figure 11:
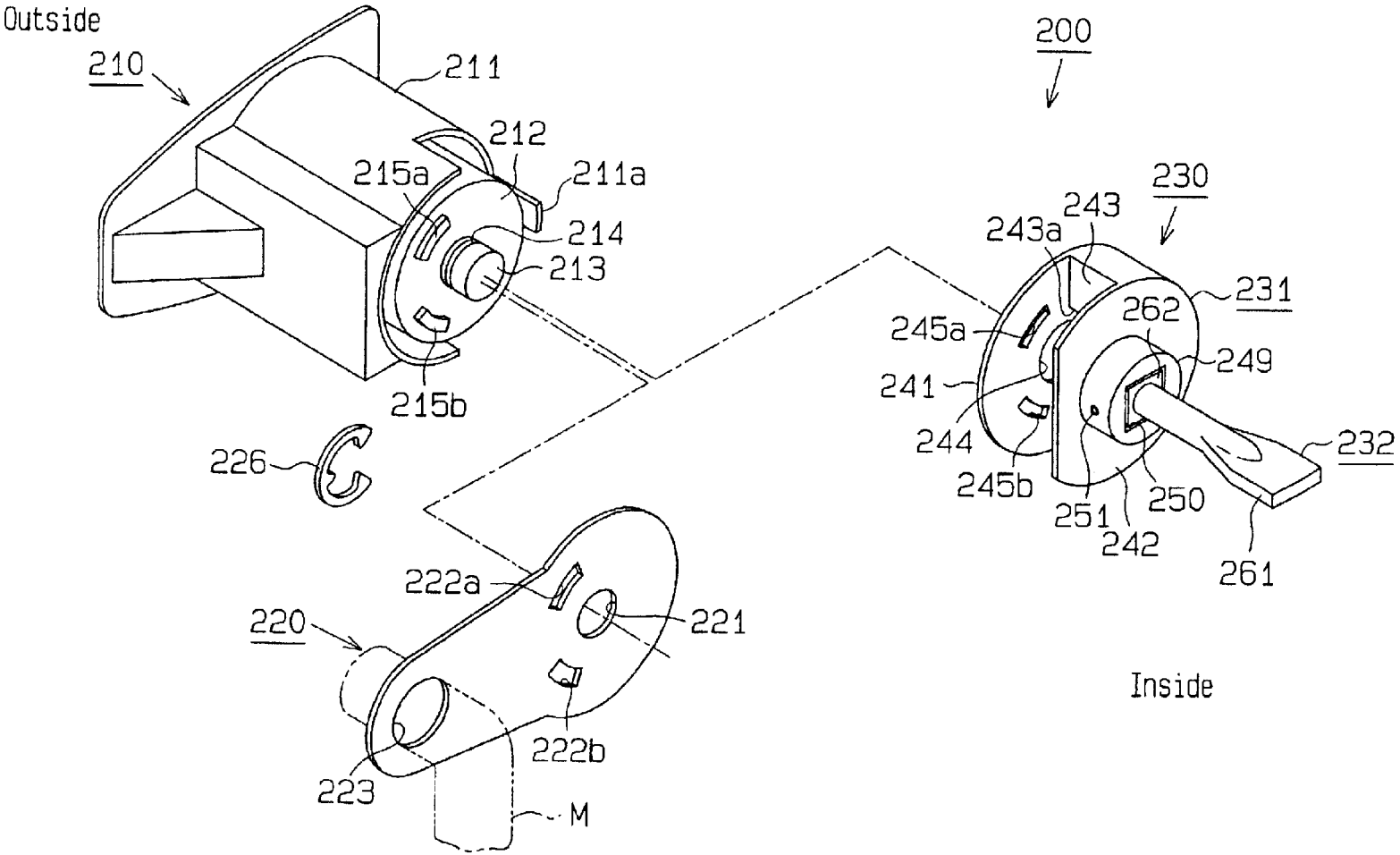
FIG. 11 is an exploded perspective view showing a key cylinder according to a third embodiment of the present invention.

Referring to FIG. 11, the key cylinder 200 includes a main body 210. The main body 210 has a rotor case 211, which is fixed to a vehicle door panel (not illustrated). An end of the rotor case 211 is semi-cylindrical. The rotor case 211 includes a lock portion 211*a*, which locks both ends of a back spring 225 (described later). The lock portion 211*a* extends in the axial direction L of the rotor case 211.

A cylindrical rotor 212 is rotatably arranged in the rotor case 211. A cylindrical insertion portion 213 projects from the middle of an end face of the rotor 212. An annular groove 214 is defined in the peripheral face of the insertion portion 213. Arcuate engagement projections 215*a*, 215*b* are formed on the end face of the rotor 212. The projections 215*a*, 215*b* are located radially outside the insertion portion 213 on the end face. The engagement projections 215*a*, 215*b* are arranged on the same circumference.

The insertion portion 213, the groove 214, and the engagement projections 215*a*, 215*b* form a mounting portion. Either one of a plate lever 220 or a lever unit 230, shown in FIG. 11, is removably attached to the mounting portion. The key cylinder 200 of a plate lever type includes the plate lever 220. The key cylinder 200 of a rod lever type includes the lever unit 230.

The plate lever 220 has a basal end. A receiving hole 221 is defined in the middle of the basal end. The insertion portion 213 is inserted in the receiving hole 221. Arcuate engagement holes 222*a*, 222*b* are defined around the receiving hole 221. The engagement holes 222*a*, 222*b* respectively receive engagement projections 215*a*, 215*b* of the rotor 212.

Figure 12A:
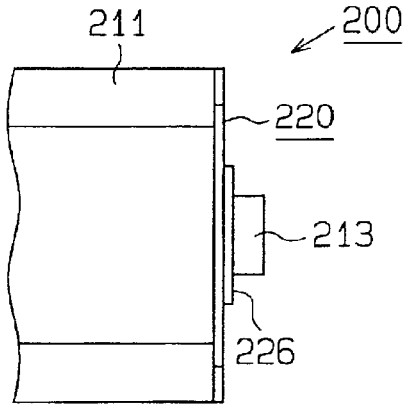
FIG. 12(*a*) is a partial side view showing the key cylinder of FIG. 11, in which a plate lever is attached to the rotor case.
Figure 12B:
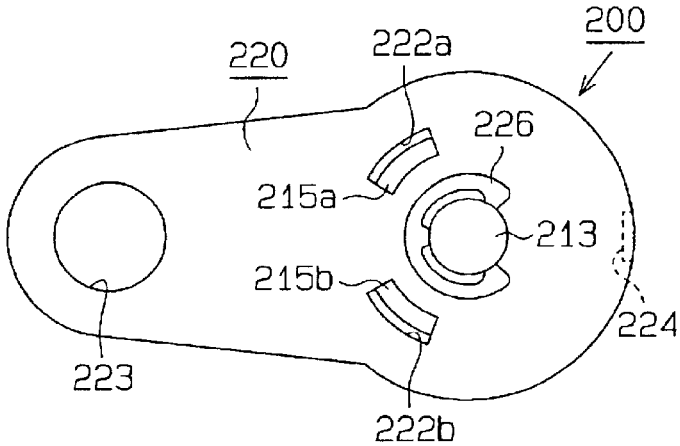
Figure 12C:
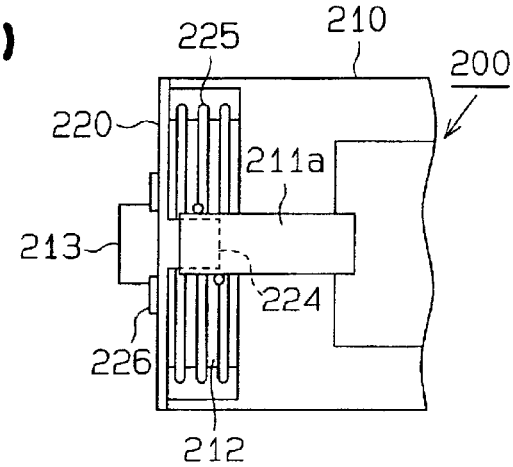
Figure 13A:
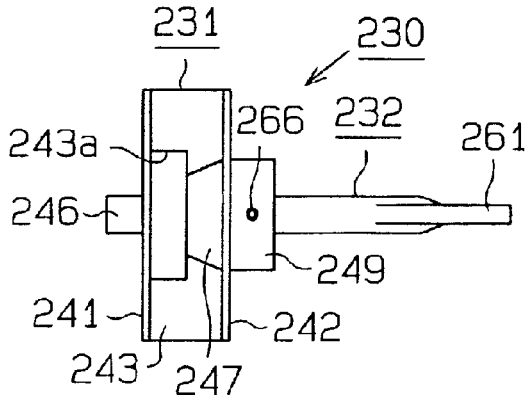
FIG. 13(*a*) is a side view showing a lever unit of FIG. 11.
Figure 13B:
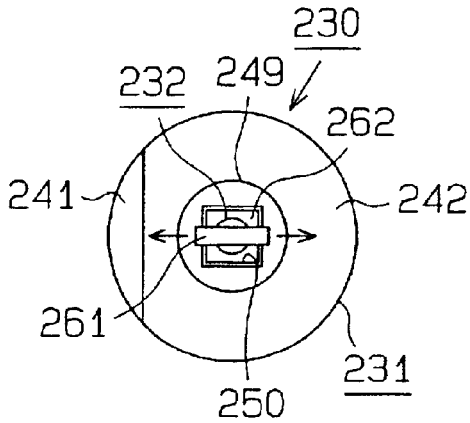
Figure 13C:
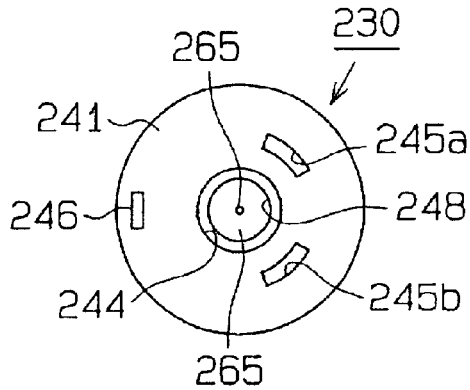
Figure 13D:
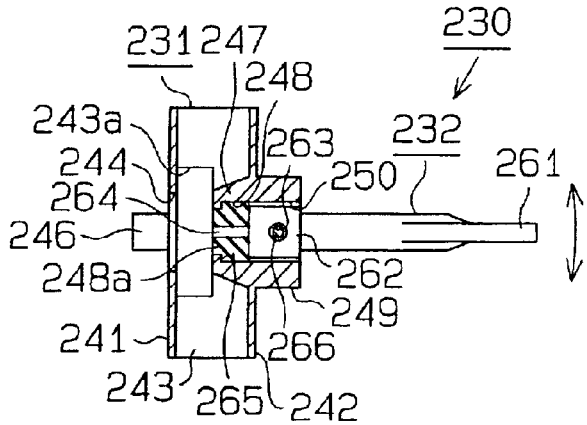

The plate lever 220 has a distal end. A hole 223 is defined in the distal end. One end of a rod M is inserted in the hole 223. The other end of the rod M is connected to the lock mechanism (not shown) in a vehicle door panel. With reference to FIGS. 12(*b*) and 12(*c*), a projection 224 is located in the periphery of the basal end of the plate lever 220. The projection 224 is perpendicular to the plate lever 220.

In the plate lever type key cylinder 200 as shown in FIGS. 12(*a*), 12(*b*), and 12(*c*), the plate lever 220 is connected to the main body 210 of the key cylinder 200. When the insertion portion 213 of the rotor 212 is inserted in the receiving hole 221 of the plate lever 220, the engagement projections 215*a*, 215*b* of the rotor 212 are also inserted in the associated engagement holes 222*a*, 222*b*. Then, a stopper ring 226, such as an E ring, is fitted in the groove 214 of the insertion portion 213.

The stopper ring 226 prevents the plate lever 220 from removing from the insertion portion 213. Each engagement projection 215*a*, 215*b* engages with the corresponding the engagement hole 222*a*, 222*b*. This transmits rotation of the rotor 212 to the plate lever 220. As a result, the plate lever 220 is integrally rotated with the rotor 212.

In the state where the plate lever 220 is attached to the end of the rotor 212, the projection 224 of the plate lever 220 is positioned inside the lock portion 211*a* of the rotor case 211 to overlap the lock portion 211*a*. When the rotor 212 is rotated by the key, the projection 224 engages one of the ends of a back spring 225 wound about the rotor 212, see FIG. 12(*c*). As a result, the back spring 225 is pulled in the direction of the rotation of the rotor 212. The rotor 212, on the other hand, is urged in a direction opposite to the direction of the rotation by elastic force of the back spring.

The lever unit 230 will now be described. As shown FIG. 11, the lever unit 230 includes an intermediary member 231 and a rod lever 232. The rod lever 232 is connected to an end face of the intermediary member 231 and is perpendicular to the end face.

The intermediary member 231 includes a pair of opposite wall members 241, 242. The wall members 241, 242 are connected to a semi-cylindrical connecting portion 243. As shown in FIG. 13(*a*), a semi-cylindrical recess 243*a* is defined inside the connecting portion 243. Referring to FIGS. 11 and 13(*c*), a circular receiving hole 244 is defined in the center of the wall member 241. The insertion portion 213 of the rotor 212 is inserted in the receiving hole 244. Half the receiving hole 244 is located in the recess 243*a*.

In the wall member 241, arcuate engagement holes 245*a*, 245*b* are defined around the receiving hole 244. The engagement holes 245*a*, 245*b* respectively receive the engagement projections 215*a*, 215*b* of the rotor 12. As shown in FIGS. 13(*a*) and 13(*c*), an engagement projection 246 is perpendicular to the wall member 241 in the vicinity of the perimeter of the wall member 241.

As shown in FIG. 13(*a*), an accommodating portion 247, which is in the form of a semi-conical frustum, projects from the middle of the inner side of the wall member 242. One end face of the accommodating portion 247 and the bottom of the recess 243*a* are substantially on the same plane. With reference to FIGS. 13(*c*) and 13(*d*), the accommodating portion 247 and the connecting portion 243 define an accommodating hole 248. The accommodating hole 248 corresponds to the receiving hole 244 of the wall member 241. A step 248*a* is formed with the opening of the accommodating hole 248.

Referring to FIGS. 11 and 13(*d*), a cylindrical retainer 249 projects from the middle of the wall member 242. A fitting hole 250, which is a rectangular cross-section, is defined in the retainer 249. The fitting hole 250 and the accommodating hole 248 communicate with each other. A pin hole 251 is formed on the peripheral wall of the retainer 249. The pin hole 251 passes through the retainer 249 in the radial direction.

A rod lever 232 includes a distal end and a basal end 262. The distal end includes a flat portion 261. The basal end 262 is a rectangular cross-section. A receiving hole 263 is defined in the basal end 262. The receiving hole 263 is perpendicular to the axis of the rod lever 232. A pin 264 juts out from the middle of an end face of the basal end 262. The pin 264 is inserted in a cushion 265, or a holder. The cushion 265 is formed from a cylindrical rubber.

With the pin 264 inserted in the cushion 265, the basal end 262 of the rod lever 232 is fitted in the fitting hole 250 of the retainer 249 from outside. The cushion 265 is accommodated in the accommodating hole 248. Movement of the cushion 265 toward the wall member 241, leftward as viewed in FIG. 13(*d*), is restricted by engagement of the cushion 65 with the step 248*a* of the accommodating hole 248.

The basal end 262 of the rod lever 232 is arranged in the fitting hole 250. In this state, a support pin 266, or a connecting pin (266), is inserted in the pin hole 251 of the retainer 249 and the receiving hole 263 of the basal end 262. As a result, the rod lever 232 is connected to the intermediary member 231. The rod lever 232 is held in the middle position where the axis of the rod lever 232 and the axis of the intermediary member 231 coincide with each other. In the present embodiment, each support pin 266 forms a support member.

A very narrow space is defined between the outer surface of the basal end 262 of the rod lever 232 and the inner surface of the fitting hole 250. The rod lever 232 is swung around the support pin 266, which serves as a fulcrum, in a direction shown by an arrow in FIG. 3(*d*) when the cushion 265 is elastically deformed.

The inner diameter of the receiving hole 263 of the basal end 262 is slightly greater than the outer diameter of the support pin 266. Also, the rod lever 232 is swung in a direction shown by arrows in FIG. 13(*b*) when the cushion is elastically deformed. When the rod lever 232 is released from force in the swing direction, which is applied by hand, the rod lever 232 returns to the middle position by the elastic force of the cushion 265.

Figure 14A:
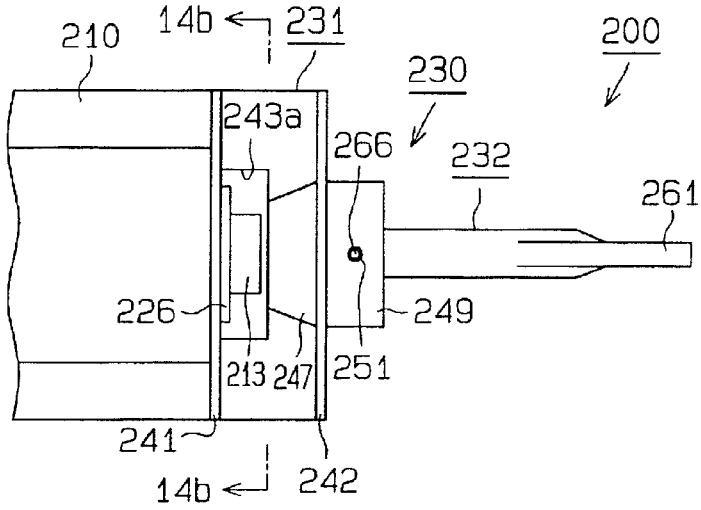
FIG. 14(*a*) is a side view of a main portion of the key cylinder of FIG. 11, in which the lever unit is attached to a main portion.
Figure 14B:
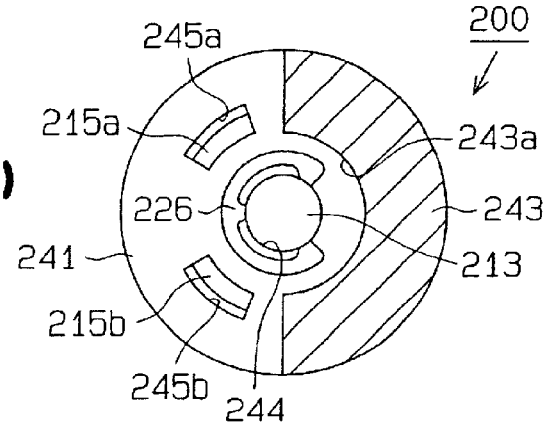
Figure 14C:
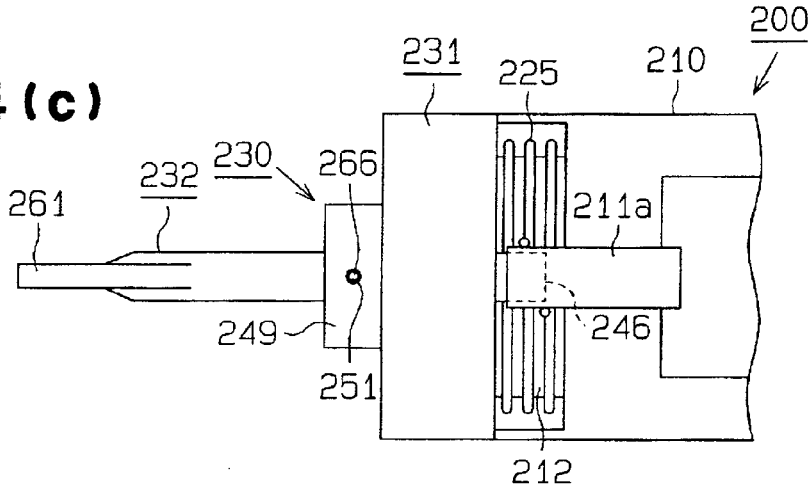

Referring to FIGS. 14(*a*) to 14(*c*), in the rod lever type key cylinder 200, the lever unit 230 is connected to the main body 210. When the insertion portion 213 of the rotor 121 is inserted in the receiving hole 244 of the wall member 241, the engagement projections 215*a*, 215*b* of the rotor 212 are also received in the associated engagement holes 245*a*, 245*b* of the wall member 241. Thereafter, the stopper ring 226, or the E ring, is fitted in the groove 214 of the insertion portion 213.

The lever unit 230 is prevented from the rotor 12 removing by the wall member 241 locked by the stopper ring 226. The engagement projections 215*a*, 215*b* engage the associated engagement holes 245*a*, 245*b*. This transmits the rotation of the rotor 212 to the lever unit 230. Accordingly, the lever unit 230 rotates integrally with the rotor 212.

In the state where the lever unit 230 is attached to the end of the rotor 212, the engagement projection 246 of the intermediary member 231 overlaps the lock portion 211*a* of the rotor case 211 and is located inside the lock portion 211*a*. When the rotor 212 is rotated by the key, the engagement projection 246 engages one of the ends of the back spring 23, see FIG. (c). As a result, the back spring 255 is pulled in the direction of the rotation of the rotor 212. The rotor 212, on the other hand, is urged in a direction opposite to the direction of the rotation by the elastic force of the back spring 225.

The third embodiment has the following effects and advantages.

Either one of the plate lever 220 or the lever unit 230 is attached to the main body 210 of the key cylinder 200. Therefore, the key cylinder according to the present embodiment easily copes with both plate lever type and rod lever type of different mounting portions. It is unnecessary to separately manufacture the rotor and rotor case that are exclusive to each type. This decreases the manufacturing costs of the key cylinder 200.

The end of the rotor 212 includes the mounting portion for the plate lever 220. The mounting portion has the insertion portion 213, the groove 214, and the engagement projections 215*a*, 215*b*. The lever unit 230 includes the intermediary member 231, which is attached to the same mounting portion used for the plate lever 220, and the rod lever 232, which is connected to the intermediary member 231. This makes it possible to cope with both plate lever 220 and rod lever 232 without altering the basic structure of the main body 210.

With the basal end 262 of the rod lever 232 accommodated in the fitting hole 250, the support pins 266 are respectively inserted in the pin hole 251 of the retainer 249 and the receiving hole 263 of the basal end 262, thereby swingably connecting the rod lever 232 to the intermediary member 231. This enables adjustment of displacement between the rod lever 232 and the lock mechanism of the door panel by use of the key cylinder 200. That is, even if the connecting portion of the lock mechanism is not situated on the axis of the rod lever 232 held in the middle position, the rod lever 232 is securely connected to the connecting portion of the lock mechanism by swinging the rod lever 232.

The main body 210 and the lever unit 230 are separately assembled in advance. When the key cylinder 200 is assembled, the lever unit 230 is simply fixed to the main body 210 with the stopper ring 226. This facilitates the assembly of the key cylinder 200 and improves the assembly efficiency.

The same main body 210 is employed regardless of the lever types. This enables mass-production of the main body 210 and a cost reduction.

The embodiments may be modified as described below.

The key cylinder 10 according to the first embodiment of FIGS. 1 to 3 and the key cylinder 100 according to the second embodiment of FIGS. 4 through 10(*d*) may also be used for a back door and a trunk.

In the first embodiment of FIGS. 1 to 3 and the second embodiment of FIGS. 4 through 10(*d*), the protector 21 may be a separate member, which is fixed to the rotor case 11.

In the first embodiment of FIGS. 1 to 3, the direction in which the key cylinder 10 is attached to the panel may be arbitrarily altered. Similarly, in the second embodiment of FIGS. 4 through 10(*d*), the direction in which the key cylinder 100 is attached may be arbitrarily altered.

In the first embodiment of FIGS. 1 to 3, the angle of each engagement step 38*a*, 38*b* or the engagement face 52*a*, 52*b* to the axis of the rotor 12 may be altered in accordance with the position of the lock mechanism of the panel.

In the second embodiment of FIGS. 4 through 10(*d*), only one of the ends of the back spring 23 may be guided.

In the third embodiment of FIGS. 11 to 14(*c*), the engagement projections 215*a*, 215*b* formed on the end face of the rotor 212 are not limited in shape. The projections 215*a*, 215*b* may be in the shape of a straight linear projection, a cylinder, a triangular prism, or a quadratic prism. In these cases, the engagement holes 222*a*, 222*b* of the plate lever 220 and the engagement holes 245*a*, 245*b* of the wall member 241 are provided to match the shapes of the corresponding engagement projections 215*a*, 215*b*. Even with these structures, the plate lever 220 or the lever unit 230 is connected to the rotor 212 to be integrally rotated with the rotor 212.

In the third embodiment of FIGS. 11 to 14(*c*), the number of engagement projections on the rotor 212 is not limited to two but may be one or more than two.

In the third embodiment of FIGS. 11 to 14(*c*), as long as the end of the rotor 212 has the mounting portion for the plate lever 220, which includes the insertion portion 213, the grooves 214, and the engagement projections 215*a*, 215*b*, the structure of the main body 210 may be altered. For instance, the structure may be formed for a free wheel type key cylinder. The free wheel type key cylinder is designed such that if a lock mechanism is tried to be opened with a key other than the authentic key, or other tools, a rotor idles with respect to a rotor case to prohibit the lock mechanism to be opened. This improves security.

The present embodiment and examples are to be considered as illustrative and not restrictive, and the invention is not to be limited to the details given herein, but may be embodied within the scope and equivalence of the appended claims.

What is claimed is:

1. A key cylinder for selectively locking and unlocking a lock mechanism, wherein the key cylinder has a rotor capable of being rotated by a key, and a lever for connecting the rotor to the lock mechanism, the key cylinder comprising:

a recess formed in an end of the rotor, wherein an end portion of the lever has a flange, which fits in the recess;

a receiving portion formed in the recess, wherein the receiving portion receives the flange; and, an elastic member located between an end surface of the flange and a bottom surface of the recess, wherein the elastic member holds the lever such that an axis of the lever and an axis of the rotor forms an angle within a predetermined range of angles, wherein the elastic member urges the flange to the receiving portion to contact with the receiving portion, and wherein the elastic member is mounted on a pin which projects from the end surface of the flange.

2. The key cylinder according to claim 1, wherein the flange has a contact surface, wherein the contact surface contacts the receiving portion and is perpendicular to the axis of the lever, wherein the receiving portion has a receiving surface, wherein the receiving surface receives the contact surface and is perpendicular to the axis of the rotor, and wherein the elastic member holds the lever such that the lever and the rotor are coaxial.

3. The key cylinder according to claim 1, wherein the elastic member is fixed to the flange.

4. The key cylinder according to claim 1 further comprising a protector for protecting the recess and the end portion of the lever.

5. The key cylinder according to claim 4 further comprising a rotor case, which holds the rotor, wherein the protector is cylindrical and extends from the rotor case.

6. A key cylinder comprising:

a rotor case;

a rotor located in the rotor case, an engagement portion being formed in the rotor, wherein the rotor is rotated in accordance with an operation of a key;

a back spring located about the rotor case, wherein the back spring is a coil spring wherein end portion of the back spring engage within the engagement portion, wherein, when the rotor is rotated by the key, the back spring urges the rotor in a direction opposite to the direction of the rotation; and a pair of guide portions formed in an end portion of the rotor, wherein, when the rotor is attached to the rotor case, the guide portions guide both end portions of the back spring to the engagement portion, and wherein each of the guide portions is a surface that is inclined with respect to an axis of the rotor, wherein the end portion of the back spring is bent radially inward.

7. The key cylinder according to claim 6, wherein the distance between the guide portions increases toward an end surface of the rotor and toward the radially outer surface of the rotor.

8. The key cylinder according to claim 6, wherein the guide portions are first and second guide portions, wherein the rotor case has a second guide portion, wherein, when the back spring is attached to the rotor case, the second guide portion guides the back spring to a predetermined position in an axial direction of the rotor case and holds the back spring at the axial position.

9. An assembly method of a key cylinder including:

mounting a back spring to an engage portion of a rotor case; and inserting a rotor, which rotates in accordance with an operation of a key, into the rotor case, wherein both end portions of the back spring are guided to an engagement portion, which is formed in the rotor, along a pair of guide portions of the rotor wherein each of the guide portions is a surface that is inclined with respect to an axis of the rotor and wherein the end portion of the back spring is bent radially inward and wherein, when a rotor is rotated by a key, the back spring urges the rotor in a direction opposite to the direction of the rotation.

* * * * *